US005127308A

United States Patent [19]

Thompson et al.

[11] Patent Number: 5,127,308

[45] Date of Patent: Jul. 7, 1992

[54] DISTRIBUTED ENERGY STORE ELECTROMAGNETIC RAILGUN

[75] Inventors: Jeffrey G. Thompson, Renton, Wash.; Doris Kuhlmann-Wilsdorf, Charlottesville, Va.

[73] Assignee: The Boeing Company, Seattle, Wash.

[21] Appl. No.: 583,285

[22] Filed: Sep. 17, 1990

[51] Int. Cl.[5] ..... F41B 6/00

[52] U.S. Cl. ..... 89/8; 124/3

[58] Field of Search ..... 89/8; 124/3

[56] References Cited

U.S. PATENT DOCUMENTS

| | | | |
|---|---|---|---|
| 2,783,684 | 3/1957 | Yoler | 89/7 |
| 3,126,789 | 3/1964 | Meyer | 89/8 |
| 4,319,168 | 3/1982 | Kemeny | 318/135 |
| 4,343,223 | 8/1982 | Hawke et al. | 89/8 |
| 4,534,263 | 8/1985 | Heyne et al. | 89/8 |
| 4,555,972 | 12/1985 | Heyne | 89/8 |
| 4,625,618 | 12/1986 | Howanick | 89/8 |

FOREIGN PATENT DOCUMENTS

| | | | |
|---|---|---|---|
| 2132322 | 11/1983 | United Kingdom | 89/8 |

OTHER PUBLICATIONS

Muller et al., "Impact Fusion with a Segmented Rail Gun", Proceedings of the Impact Fusion Workshop, Los Alamon, N.M., Aug. 1979, pp. 156–163.

Haight, C. H. et al., "Distributed Energy Store (DES) Railgun Development," pp. 81–84.

*Primary Examiner*—Stephen C. Bentley

*Attorney, Agent, or Firm*—Christensen, O'Connor, Johnson & Kindness

[57] ABSTRACT

A distributed energy store electromagnetic railgun comprising a plurality of sections, each section having a connector portion and a barrel portion that includes a rail surface. The sections are arranged to form first and second rails. The sections forming each rail are positioned such that their rail surfaces form a substantially continuous barrel surface. The rails are positioned such that their barrel surfaces define a barrel having a longitudinal axis, a breech end, and a muzzle end. For each section, the connector portion is positioned closer than the rail surface to the breech end by greater than the length of an armature, in a direction along the longitudinal axis. Electrical current is provided to each section through its connector portion. Current does not flow through a section until the armature, or a plasma behind an insulating projectile, reaches the rail surface of the section.

8 Claims, 2 Drawing Sheets

DISTRIBUTED ENERGY STORE ELECTROMAGNETIC RAILGUN

FIELD OF THE INVENTION

The present invention relates to electromagnetic railguns and, in particular, to a distributed energy store railgun having energy sources distributed along its length.

BACKGROUND OF THE INVENTION

FIG. 1 schematically illustrates the general construction of a prior art electromagnetic railgun. The railgun includes a pair of rails 12 and 14 that typically comprise a pair of metal plates positioned parallel to and spaced apart from one another. Rails 12 and 14 form barrel 16 that includes breech end 18 and muzzle end 20. Armature 22 is sized so as to slide between rails 12 and 14. The armature may be part or all of the projectile that is fired by the railgun. Rails 12 and 14 are connected to capacitor 24 via lines 26 and 28 and switch 30.

In one type of railgun, armature 22 is electrically conductive, and makes sliding electrical contact with rails 12 and 14. When switch 30 is closed with the armature at breech end 18, current begins to flow between the rails through the armature, the current path through the armature being designated by reference numeral 32. This current produces a magnetic field to the left of the armature, and directed into the plane of the drawing. This magnetic field interacts with the current flowing through the armature via path 32, to create an electromagnetic force that causes the armature to accelerate to the right along barrel 16, and out of muzzle end 20 of the railgun. In a second type of railgun, known as a plasma armature railgun, current flows along path 34 through a plasma created by the electrical field between the rails to the left of an electrically insulating projectile which is used in place of the armature. Current through the plasma interacts with the magnetic field generated by the current in the rails and results in acceleration of the plasma, and therefore of the insulating projectile, to the right along barrel 16.

In a distributed energy store railgun, the energy sources, e.g., the capacitors, switches, and connecting lines, are distributed along the length of the barrel, as opposed to at the breech end of the barrel. All capacitors are precharged, and are sequentially discharged in timed relationship to one another when the railgun is fired. In particular, the switch associated with each capacitor is closed as the armature passes the point at which the connecting lines from that capacitor feed electrical current into the rails. Current fed in before the armature reaches this point must be avoided, since it will tend to accelerate the armature in the wrong direction. Because of the requirement for precise timing of the discharges of the different energy sources, relatively complex control circuits are necessary for reliable operation of conventional distributed energy store railguns.

SUMMARY OF THE INVENTION

The present invention provides a distributed energy store railgun that eliminates the need for sensing and switching means to control the timing of the energy discharges.

In a preferred embodiment, the railgun of the present invention comprises a plurality of mutually electrically insulated sections, each section comprising a connector portion and a barrel portion having a rail surface. The sections are arranged to form first and second rails. The sections forming each rail are positioned such that their rail surfaces form a substantially continuous barrel surface. The rails are positioned such that their barrel surfaces are parallel to and spaced apart from one another, so as to define a barrel having a longitudinal axis, a breech end and a muzzle end. For each section, the connector portion is positioned closer than the rail surface to the breech end, in a direction along the longitudinal axis. Finally, the railgun includes means for providing electrical current to the connector portion of each section. This arrangement ensures that current does not flow through a section until a projectile, or a plasma behind an insulating projectile, reaches the rail surface of the section. Electromagnetic forces resulting from the current through the section and through the projectile or plasma accelerate the projectile toward the muzzle end.

In a preferred embodiment, the connector portion of each section is spaced outwardly with respect to the rail surface of the section, in a direction perpendicular to the longitudinal axis. The barrel portion of an adjacent section of the same rail is positioned between the connector portion and the barrel surface, such that the sections of each rail are arranged in a nested structure and such that the rail surfaces form a substantially continuous barrel surface. This configuration permits ready adjustment of the length of the barrel by adjusting the length of the rail section. In another preferred embodiment, electrical current is provided to each connector portion at a position on the connector portion closest to the breech end, and such position is distanced from the rail surface of the connector by a distance greater than the length of the projectile.

BRIEF DISCUSSION OF THE DRAWINGS

DETAILED DESCRIPTION OF THE INVENTION

Figure 1:
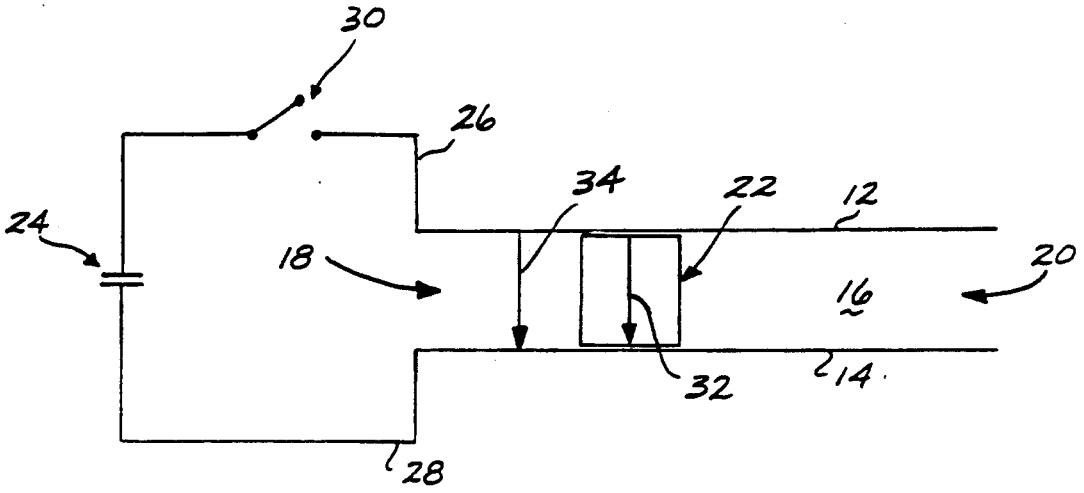
Fig. 1. PRIOR ART
FIG. 1 is a schematic diagram of a prior art railgun.
Figure 2:
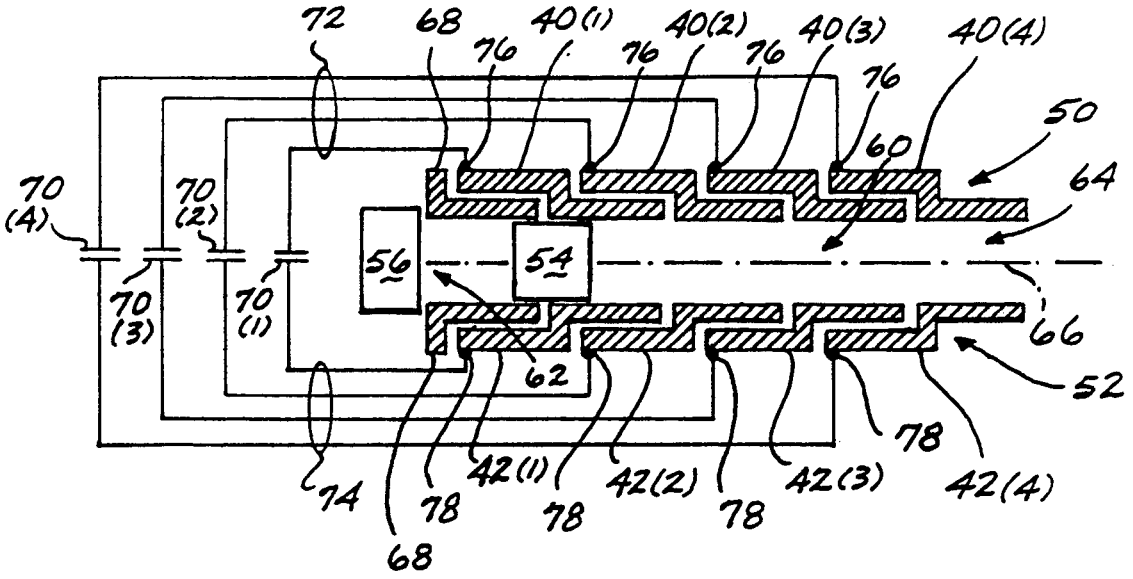
FIG. 2 is a schematic diagram of a railgun according to the present invention.
Figure 3:
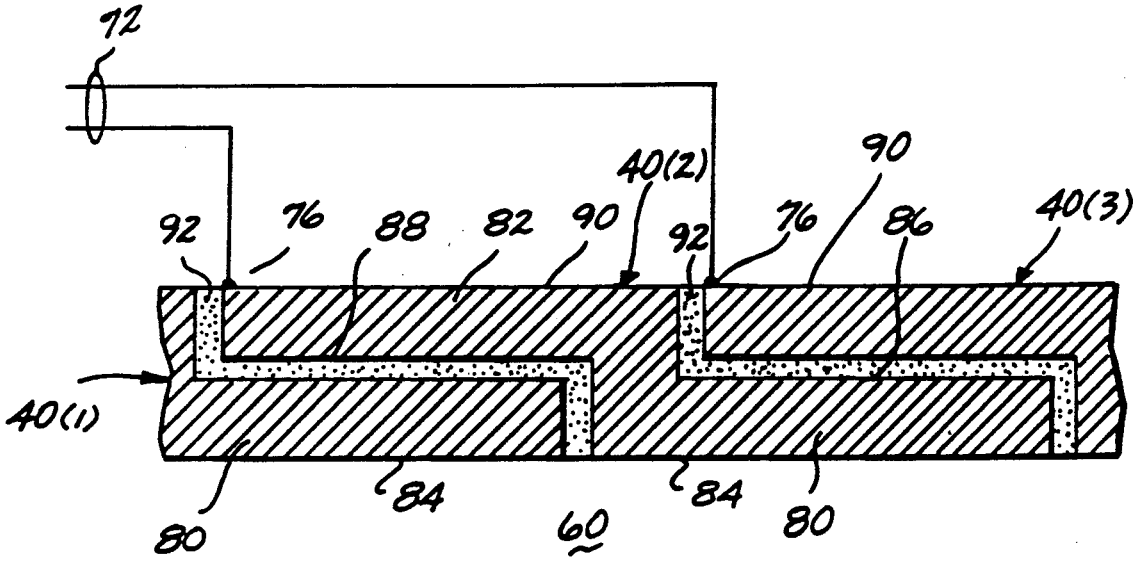
FIG. 3 is an expanded view of one of the sections of the railgun of FIG. 2 and associated elements.

A schematic view of a preferred embodiment of the railgun of the present invention is set forth in FIGS. 2 and 3. The railgun comprises four upper sections 40(1) through 40(4), and four lower sections 42(1) through 42(4). Four sections have been selected for ease of illustration, and in general any number of upper and lower sections greater than one may be employed. The terms "upper" and "lower" refer to locations in the Figures, and do not indicate a preferred spatial orientation of the railgun. Upper sections 40 interlock with one another, as indicated in FIG 2, to form a substantially continuous upper rail 50. Similarly, lower sections 42 interlock with one another, to form a substantially continuous lower rail 52. Upper and lower rails 50 and 52 are positioned parallel to and spaced apart from one another, to form barrel 60 having breech end 62, muzzle end 64 and longitudinal axis 66. The barrel is dimensioned such that the electrically conductive armature can slide along longitudinal axis 66 in electrical contact with the rails. Thus the barrel can have any desired cross-sectional shape, as long as it corresponds to the cross-sectional shape of the armature.

In a preferred embodiment, all upper and lower sections are identical to one another, with each lower section simply being rotated 180° with respect to the opposite upper section about longitudinal axis 66. Inserts 68 are positioned adjacent breech end 62 to provide a continuous inner diameter for the barrel. An optional propulsion means 56 is located at breech end 62, and serves to initially launch armature 54 down barrel 64. Propulsion means 56 can comprise a light gas gun accelerator, another railgun, or any other means for providing an initial velocity to the armature.

The railgun in FIG. 2 also includes energy storage capacitors 70(1) through 70(4). Each capacitor 70 has one of its plates connected to a corresponding upper section 40 by one of lines 72, while the other plate of the capacitor is connected by one of lines 74 to the lower section 42 that is positioned directly opposite upper section 40 across barrel 60. Each of lines 72 is connected to its respective upper section at a connection point 76 that is located at the leftmost end of the upper section, as viewed in FIG. 2. Similarly, each of lines 74 is connected to its respective lower section at a connection point 78 that is also located at the leftmost end of the lower section. The reason for this arrangement is set forth below.

FIG. 3 illustrates upper rail 50, and in particular one of the upper sections 40(2) and the interface between adjacent upper sections, in greater detail. Upper section 40(2) includes barrel portion 80 and connector portion 82. Barrel portion 80 includes rail surface 84 and outer surface 86. Rail surface 84 forms a portion of the barrel surface of the rail of which section 40(2) is part. Connector portion 82 includes inner surface 88 and outer surface 90. Inner surface 88 is spaced outward with respect to rail surface 84, for a distance great enough to permit barrel portion 80 of the adjacent upper section 40(1) to be accommodated between the connector portion of upper section 40(2) and the barrel, such that rail surfaces 84 of the adjacent upper sections are substantially coplanar, and form a smooth barrel surface. Insulation 92 is positioned between adjacent upper sections, to electrically insulate the upper sections from one another. While insulation 92 between connector portion 82 and adjacent connector portions 82 of abutting sections may be of any thickness, the insulation between rail surfaces 84 should be as thin as possible while providing adequate electrical insulation between adjacent sections. Connection point 76 are positioned at the leftmost end of each outer surface 90 to connect the upper sections to their respective capacitors via lines 72. The corresponding details of lower rail 52 are preferably identical to those of upper rail 50.

It can be appreciated that alternative arrangements for the upper and lower rails are possible. Specifically, each upper section 40 may have connector portions 82 which are shaped differently than as illustrated in FIG. 3. Although the preferred embodiment of FIG. 3 shows inner surface 88 of the connector portion 82 to be parallel to the longitudinal axis 66, inner surface 88 and hence connector portion 82 may be oriented at any angle with respect to longitudinal axis 66. The important consideration is that the connection point 76 of connector portion 82 is located greater than the length of armature 54 towards the breech end 62 from the leftmost point of the corresponding rail surface 84.

Figure 4:
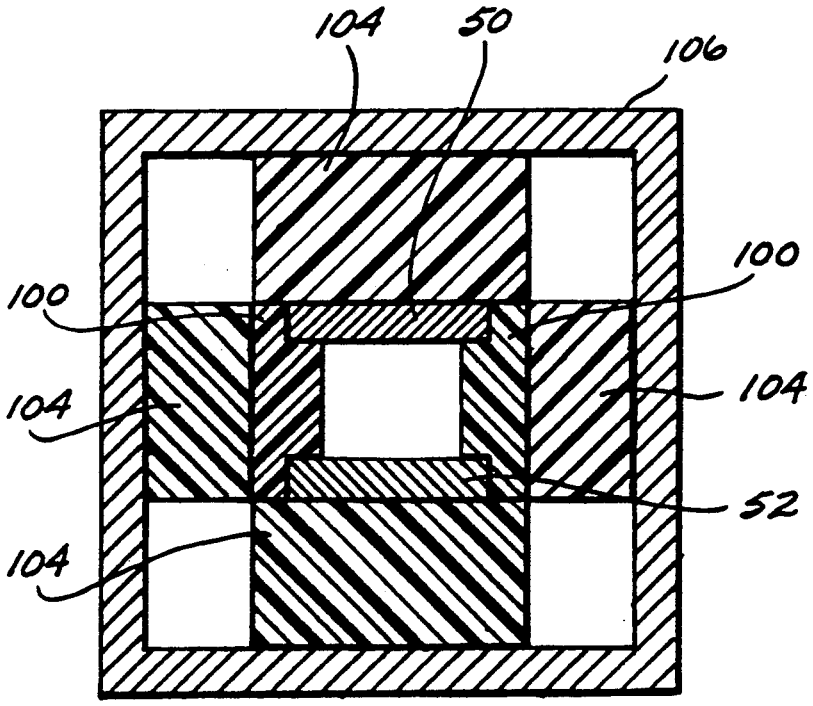
FIG. 4 is a cross-sectional view of the railgun of the present invention, showing a suitable support structure.

FIG. 4 provides an end view of the railgun, and illustrates a suitable support structure for the rails. In particular, upper rail 50 and lower rail 52 are mounted between spacers 100 that are in turn supported by blocks 104 within frame 106. The spacers and blocks may be divided into sections similar to the rail sections, or provided as continuous members. Suitable openings (not shown) are provided in the support structure, to provide access to the rail sections for lines 72 and 74.

In operation, capacitors 70 are charged, and armature 54 is then launched to the right from breech end 62 of barrel 60, by propulsion means 56. Armature 54 is sized such that it makes sliding electrical contact with the inner surfaces of the upper and lower sections, i.e., with rail surfaces 84 (FIG. 3). Thus, when armature 54 reaches the point at which its leading end makes electrical contact with the rail surfaces of the barrel portions of sections 40(1) and 42(1), an electrical circuit is completed from capacitor 70(1), and electrical current flows between sections 40(1) and 42(1) through the armature. Connection points 76 nd 78 are located at the breech end of the connector portions of sections 40(1) and 42(1) such that when armature 54 first makes contact with the rail surfaces of these sections, the armature has already moved past the connection points. As is known to those skilled in this art, the electromagnetic forces resulting from the current tend to expand the current loop, by accelerating the armature towards the muzzle end of the barrel. Thus, this geometrical arrangement ensures that when current begins flowing through a given pair of upper and lower sections, the current produces a force in the appropriate (rightward) direction. For each of sections 40 and 42, connection points 76 and 78 should be located towards breech end 62 with respect to the rail surface of the barrel portion of the section. For the illustrated armature railgun, the distance between the connection point and the breech end of the corresponding rail surface of each section should be greater than the full length of the armature.

The process described above continues as the armature reaches each pair of upper and lower sections, such that capacitors 70 are discharged in turn as the armature travels down the barrel. As a result of the described arrangement, the distributed energy store railgun does not require complex switching or timing mechanisms to ensure that the capacitors are discharged at the correct times. In effect, the required timing is produced by the geometrical arrangement of the barrel sections.

While the preferred embodiments of the invention have been described, variations will be apparent to those skilled in the art. For example, while it is generally necessary for barrel portions 80 of adjacent sections to closely abut with one another, separated only by a thin insulating material, to form the barrel, it is not necessary for connector portions 82 to abut nor to be aligned with one another. Furthermore, insulation 92 between connector portions 82 can be any thickness to accommodate connector portions 82. Accordingly, the length of the connector portions along the barrel longitudinal axis need not be equal to the corresponding lengths of the barrel portions, as in the embodiment of FIG. 3. For example, the connector portions could be made substantially shorter than the barrel portions, e.g., the connector portion lengths could be equal to the armature length, or a little longer, while the barrel portions could be substantially longer. Accordingly, the scope of the invention is to be determined with reference to the following claims.

The embodiments of the invention in which an exclusive property of privilege is claimed are defined as follows:

1. A distributed energy store electromagnetic railgun for utilizing electromagnetic forces to accelerate a projectile, the railgun comprising:

a plurality of sections, each section comprising a connector portion and a barrel portion having a rail surface, the sections being arranged to form first and second rails, the sections forming each rail being positioned such that their rail surfaces form a substantially continuous barrel surface, the rails being positioned such that their barrel surfaces are parallel to and spaced apart from one another so as to define a barrel having a longitudinal axis, a breech end and a muzzle end, each section further including a connector portion that is positioned closer than the rail surface to the breech end in a direction along the longitudinal axis and that is spaced outwardly with respect to the rail surface in a direction perpendicular to the longitudinal axis, the barrel portion of an adjacent section of the same rail being positioned between the connector portion and the barrel, whereby the sections of each rail are arranged in a nested structure; and means for providing electrical current to each connector portion;

whereby for each section, current does not flow through the section until the projectile or a plasma behind the projectile reaches the rail surface of the section, such that the electromagnetic forces resulting from the current through the section accelerates the projectile towards the muzzle end.

2. The railgun of claim 1, further comprising electrical insulation positioned between adjacent sections to electrically insulate the adjacent sections from one another.

3. The railgun of claim 1, wherein the means for providing electrical current to each connector portion provide said current at a position on the connector portion closest to the breech end of the railgun and such that said position is distanced from the rail surface of the connector by a distance greater than the length of the projectile.

4. The railgun of claim 3, wherein the means for providing electrical current comprises charge storage means connected between a pair of sections positioned opposite one another across the barrel.

5. A distributed energy store electromagnetic railgun for utilizing electromagnetic forces to accelerate a projectile, the railgun comprising:

a plurality of sections, each section comprising a connector portion and a barrel portion having a rail surface, the sections being arranged to form first and second rails, the sections forming each rail being positioned such that their rail surfaces form a substantially continuous barrel surface, the rails being positioned such that their barrel surfaces are parallel to and spaced apart from one another so as to define a barrel having a longitudinal axis, a breech end and a muzzle end, each section further including a connector portion that is positioned closer than the rail surface to the breech end in a direction along the longitudinal axis and that is spaced outwardly with respect to the rail surface in a direction perpendicular to the longitudinal axis, the barrel portion of an adjacent section of the same rail being positioned between the connector portion and the barrel, whereby the sections of each rail are arranged in a nested structure; and energy storage means for providing electrical current from the energy storage means directly to each connector portion such that current flows through the corresponding section as a direct consequence of the projectile, or a plasma behind the projectile, reaching the rail surface of the section, such that the electromagnetic forces resulting from the current through the section accelerates the projectile towards the muzzle end.

6. The railgun of claim 5, further comprising electrical insulation positioned between adjacent sections to electrically insulate the adjacent sections from one another.

7. The railgun of claim 5, wherein the energy storage means provides said current at a position on the connector portion closest to the breech end of the railgun and such that said position is distanced from the rail surface of the connector by a distance greater than the length of the projectile.

8. The railgun of claim 7, wherein the energy storage means comprises charge storage means connected between a pair of sections positioned opposite one another across the barrel.

* * * * *

UNITED STATES PATENT AND TRADEMARK OFFICE

CERTIFICATE OF CORRECTION

PATENT NO. : 5,127,308
DATED : July 7, 1992
INVENTOR(S) : J.G. Thompson et al.

It is certified that error appears in the above-identified patent and that said Letters Patent is hereby corrected as shown below:

| COLUMN | LINE | |
|---|---|---|
| 3 | 14 | after "railgun" insert --shown-- |
| 3 | 34 | after "is" insert --a-- |
| 3 | 51 | "point" should read --points-- |
| 4 | 21 | "nd" should read --and-- |
| 5 | 42 | "provide" should read --provides-- |

Signed and Sealed this

Tenth Day of August, 1993

*Attest:*

Michael K. Kirk

MICHAEL K. KIRK

*Attesting Officer*

*Acting Commissioner of Patents and Trademarks*